US007395687B2

(12) United States Patent
Koenig et al.

(10) Patent No.: US 7,395,687 B2
(45) Date of Patent: Jul. 8, 2008

(54) METHOD FOR PRODUCING A WORKPIECE IN THE FORM OF A METAL SHEET WITH AT LEAST ONE AT LEAST PARTLY ROLLED EDGE, AND WORKPIECE PRODUCED IN SUCH A WAY

(75) Inventors: Werner Koenig, Oberkirch (DE); Hansjoerg Schneider, Appenweier (DE); Uwe Panther, Oberkirch (DE); Volker Bienmueller, Rheinhausen (DE)

(73) Assignee: PROGRESS-WERK Oberkirch AG, Oberkirch (DE)

( * ) Notice: Subject to any disclaimer, the term of this patent is extended or adjusted under 35 U.S.C. 154(b) by 13 days.

(21) Appl. No.: 11/402,559

(22) Filed: Apr. 12, 2006

(65) Prior Publication Data

US 2006/0230808 A1 Oct. 19, 2006

(30) Foreign Application Priority Data

Apr. 13, 2005 (DE) ..... 10 2005 018 284

(51) Int. Cl.
*B21D 31/00* (2006.01)
*B21D 7/02* (2006.01)

(52) U.S. Cl. ..... 72/379.2; 72/214

(58) Field of Classification Search ..... 72/172, 72/182, 214, 220, 379.2, 316, 411; 428/595
See application file for complete search history.

(56) References Cited

U.S. PATENT DOCUMENTS

| | | | | |
|---|---|---|---|---|
| 1,555,895 A | | 10/1925 | Weber | |
| 2,275,220 A | * | 3/1942 | Enkur | 72/371 |
| 2,394,019 A | * | 2/1946 | Socke | 72/172 |
| 3,350,751 A | * | 11/1967 | Groschke | 29/428 |

FOREIGN PATENT DOCUMENTS

GB 403594 12/1933

* cited by examiner

*Primary Examiner*—Derris H. Banks
*Assistant Examiner*—Teresa Bonk
(74) *Attorney, Agent, or Firm*—Harness, Dickey & Pierce, P.L.C.

(57) ABSTRACT

A method for producing a workpiece in the form of a metal sheet with at least one at least partly rolled edge, said at least one edge to be rolled having a length in a longitudinal direction and a curvature in at least one portion along said longitudinal direction, comprises the steps of providing said workpiece, in said at least one portion which has said curvature, with at least one material projection extending in said longitudinal direction of said edge over a part of said length of said at least one edge to be rolled, so that said edge, along said material projection, projects beyond remaining portions of said edge adjoining said material projection transversely to said longitudinal direction of said edge, and subsequently rolling said edge including said material projection.

14 Claims, 2 Drawing Sheets

METHOD FOR PRODUCING A WORKPIECE IN THE FORM OF A METAL SHEET WITH AT LEAST ONE AT LEAST PARTLY ROLLED EDGE, AND WORKPIECE PRODUCED IN SUCH A WAY

CROSS REFERENCE TO RELATED APPLICATION

The present application claims priority of German patent application No. 10 2005 018 284.4 filed on Apr. 13, 2005.

BACKGROUND OF THE INVENTION

The invention relates to a method for producing a workpiece in the form of a metal sheet with at least one at least partly rolled edge, the at least one edge to be rolled having a curvature in at least one portion.

The invention also relates to a workpiece produced according to the abovementioned method in the form of a metal sheet having at least one at least partly rolled edge.

It is known to roll edges of metal sheets, for example in order to obtain a reinforced margin of the metal sheet, or in order to produce, for example, a hinge lug on the metal sheet.

To roll an edge of the workpiece in the form of a metal sheet, the workpiece is put into a special rolling tool which has a tool top part and a tool bottom part. The tool top part and the tool bottom part are movable relative to one another. In one of the two tool parts, there is a hollow in the shape of a circle segment in cross section, into which the workpiece, with the edge to be rolled at the front, is pressed by the relative movement between tool bottom part and tool top part. When the edge continues to be pressed into the circle-segment-shaped hollow, the edge rolls along the inner wall of the circle-segment-shaped hollow. The edge may be rolled, for example, only partly, for example over a rolling angle of 90° to 180°, or beyond 180° until a rolling angle of almost 360° is achieved, i.e. until the edge is rolled completely.

The workpieces that can be rolled are not only those whose edge to be rolled is straight but also those whose edge to be rolled has a curvature in at least one section, which also includes the case where the edge to be rolled has a curvature or bend over its entire length to be rolled.

In the case of sheet metal edges which have such a curvature, it has been found that an undesirable kink is produced in the region of the curvature during the rolling of the edge, i.e. the workpiece has a kink in the rolled margin in the region of the curvature after the rolling of the edge, and this kink prevents or even completely rules out the usefulness of the workpiece for the subsequent purpose, for example as a component in the motor vehicle industry. Such a kink can impair not only the aesthetic appearance of the workpiece produced in this way but also its strength or stability, since the kink produced can become greater during loading or stressing of the workpiece.

SUMMARY OF THE INVENTION

The object of the invention is therefore to improve a method of the type mentioned at the beginning to the effect that, during the rolling of the edge of the workpiece, the risk of a kink being produced in the rolled edge is avoided or at least reduced.

According to an aspect of the invention, a method for producing a workpiece in the form of a metal sheet with at least one at least partly rolled edge is provided, the at least one edge to be rolled having a length in a longitudinal direction and a curvature in at least one portion along the longitudinal direction. The method comprises the steps of providing the workpiece, in the at least one portion which has the curvature, with at least one material projection extending in the longitudinal direction of the edge over a part of the length of the at least one edge to be rolled, so that the edge, along the material projection, projects transversely to the longitudinal direction of the edge beyond remaining portions of the edge adjoining the material projection, and subsequently rolling the edge including the material projection.

According to another aspect of the invention, a workpiece in the form of a metal sheet having at least one at least partly rolled edge is provided. The workpiece is produced according to a method comprising the steps of providing the workpiece, in the at least one portion which has the curvature, with at least one material projection extending in the longitudinal direction of the edge over a part of the length of the at least one edge to be rolled, so that the edge, along the material projection, projects transversely to the longitudinal direction of the edge beyond remaining portions of the edge adjoining the material projection, and subsequently rolling the edge including the material projection.

It has been found that the risk of a kink forming in the edge in the region of the curvature of the edge during the rolling can be avoided or at least reduced if the workpiece has additional material in the form of the abovementioned material projection in the region of the curvature of the edge, this material projection being rolled into place together with the remaining edge during the rolling operation. The extent to which the material projection projects transversely to the longitudinal direction of the edge beyond the edge adjoining the material projection is expediently selected in such a way that the material projection does not reduce or does not substantially reduce the rolling angle to be achieved. This is unproblematic if a rolling angle of 180° is selected, i.e. the edge to be rolled is rolled into place by about 180°, since there is still sufficient space for the material projection within the rolled edge in this case. The material projection provided according to the invention extends in the longitudinal direction of the edge to be rolled preferably over a part of the edge to be rolled which corresponds approximately to the length of the portion of the edge in which the curvature is present.

According to a preferred embodiment, the at least one material projection extends across the smallest radius of the curvature.

This measure is advantageous in particular when the edge to be rolled has a curvature whose radius of curvature is not constant across the curvature but rather varies. This may be the case, for example, if the workpiece has a curved section and a straight section. From the transition of the straight section into the curved section, the radius of curvature at first increases continuously until a region of the smallest radius is reached. In such a configuration, the at least one material projection is arranged in the region of the smallest radius of curvature and preferably extends beyond the smallest radius of curvature.

In a further preferred embodiment, the edge of the at least one material projection merges smoothly into the edge adjoining the material projection.

This measure has the advantage that notch effects or crack formations are avoided during the rolling of the edge in the transition region from the edge of the material projection into the edge or edges adjoining the material projection.

Furthermore, in this context, it is preferred if the edge of the at least one material projection merges in a sloping straight line or in a convex or concave line into the edge adjoining the material projection.

The abovementioned configurations represent advantageous examples of a smooth transition of the edge of the material projection into the edge adjoining the material projection.

In a further preferred configuration, the material projection is formed in one piece with the remaining material of the workpiece.

This measure has the advantage that the cost of producing the workpiece is not increased compared with the conventional method, in which no material projection as described above is provided, since, in the case of a one-piece configuration of the material projection, the latter can already be taken into account during the prefabrication of the workpiece to be rolled, i.e. it need not be attached as an additional component to the workpiece.

In this connection, provision is preferably made for the workpiece to be provided together with the material projection as a one-piece punched part.

This constitutes a means of forming the material projection in one piece with the rest of the material of the workpiece which is especially simple in terms of production and is therefore advantageously cost-effective.

A workpiece produced according to the invention in accordance with one or more of the abovementioned configurations in the form of a metal sheet having at least one at least partly rolled edge has the advantage that it is free of kinks in the region of the curvature or in the region of the curvatures of the edge or any kink is less pronounced than in the conventionally produced workpieces.

Further advantages and features follow from the description below and the attached drawings.

It goes without saying that the abovementioned features and the features still to be explained below can be used not only in the respectively specified combinations but also in other combinations or on their own without departing from the scope of the present invention.

BRIEF DESCRIPTION OF THE DRAWINGS

An exemplary embodiment of the invention is shown in the drawing and is described in more detail below with reference thereto. In the drawings:

FIGS. 1*a*)-1*f*) show a method of producing a workpiece in the form of a metal sheet with a partly rolled edge in three schematically shown method stages, FIG. 1*a*) showing the workpiece in side view in a first method stage, FIG. 1*b*) showing the workpiece together with the tool in an end view, FIGS. 1*c*) and 1*d*) showing the workpiece in side view and respectively the workpiece and the tool in end view in a second method stage, and FIGS. 1*e*) and 1*f*) showing the workpiece in side view and the tool in end view in a third method stage; where

DETAILED DESCRIPTION OF A PREFERRED EXEMPLARY EMBODIMENT

Figure 1:
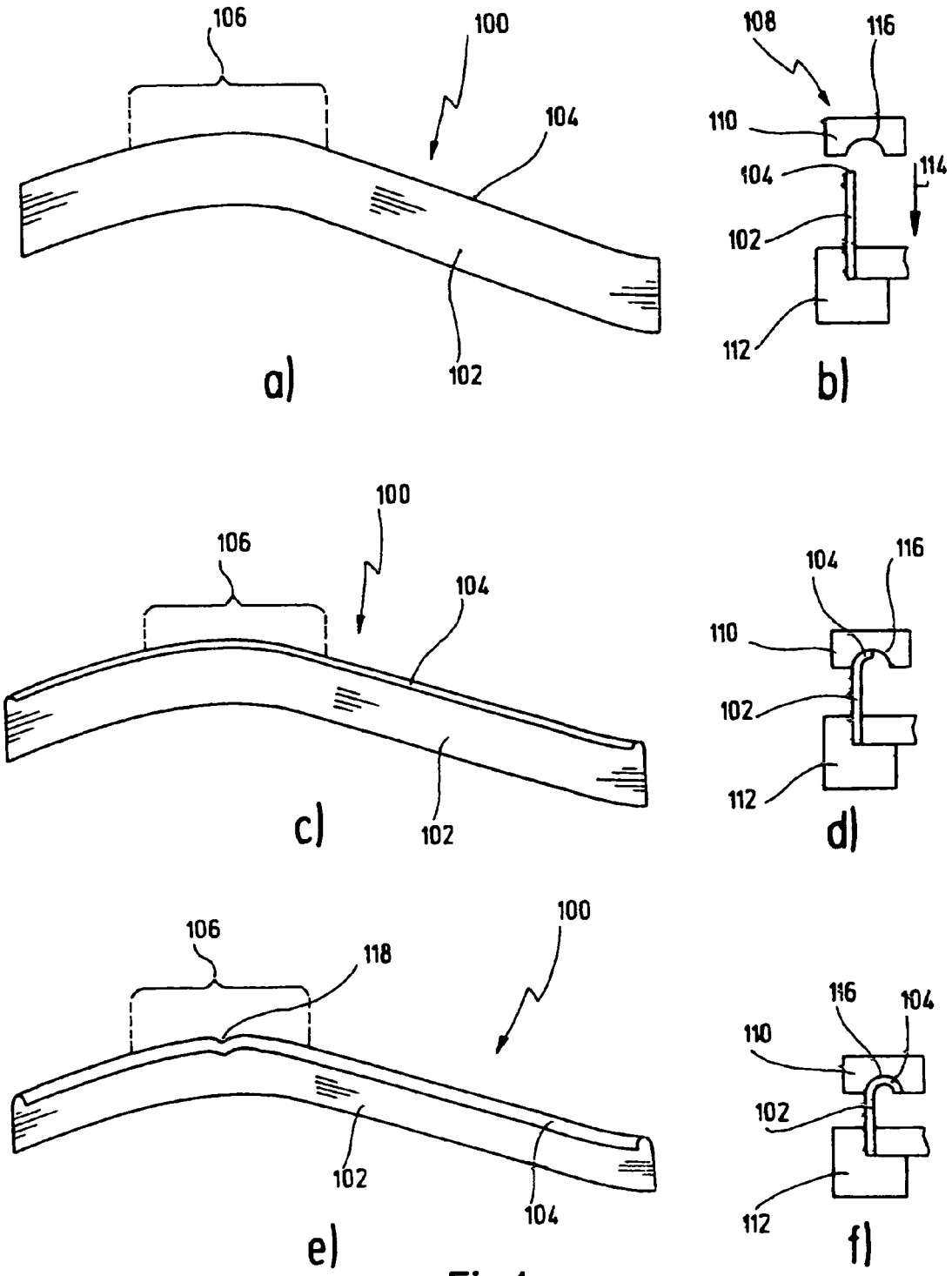
Fig.1 (PRIOR ART)
FIG. 1 represents the prior art.

First of all a method for producing a workpiece in the form of a metal sheet having an at least partly rolled edge according to the prior art is described with reference to FIG. 1.

Shown in FIG. 1*a*) is a workpiece which is provided with the general reference numeral 100 and is provided in the form of a metal sheet 102. The metal sheet 102 has an edge 104 which is to be rolled. Rolling is a forming operation within the scope of non-cutting shaping production, during which a sheet edge is generally bent over, so the bent-over edge is essentially in the form of a circle segment as viewed in cross section. However, the shape of the bent-over edge need not be a circular shape but rather may also be a shape differing therefrom in cross section.

The workpiece 102 according to FIG. 1*a*) has a portion 106 in which the workpiece 102 and in particular the edge 104 has a curvature.

According to FIG. 1*b*), the metal sheet 102 is put into a rolling tool 108, which has a tool top part 110 and a tool bottom part 112. The tool top part 110 can be moved in the direction of an arrow 114 towards the tool bottom part 112.

Of course, provision may also be made for the tool top part 110 to be fixed and for the tool bottom part 112 to be movable opposite the direction of the arrow 114 towards the tool top part 110.

In the tool top part 110, there is a semicircular hollow or cavity 116 which serves to roll the edge 104. The edge 104 to be rolled is normally tilted slightly before the rolling contrary to the illustration in FIG. 1*b*).

The metal sheet 102 is firmly clamped in place in the tool bottom part 112.

A second stage of the rolling operation is shown in FIGS. 1*c*) and 1*d*). The edge 104 has now been rolled by about 90° by pressing the metal sheet 102, with the edge 104 to be rolled at the front, into the tool top part 110. FIG. 1*c*) shows the metal sheet 102 in side view in this intermediate stage of the rolling operation.

FIGS. 1*e*) and 1*f*) now show the third stage of the rolling operation, in which the edge 104 has been rolled by 180°. Shown in FIG. 1*e*) is the fact that, during the further rolling of the edge 104 starting from FIG. 1*c*) to FIG. 1*e*), an undesirable kink 118 has formed in the section 106 in which the metal sheet 102 has the curvature, and this kink 118 reduces or even completely removes the usefulness of the workpiece 102 for its further processing or its subsequent intended use. The conventional method does not ensure that a curved edge of a workpiece can be rolled without kinks.

A method according to the invention which remedies the kinking problem described above with reference to FIG. 1 will now be described with reference to FIG. 2.

FIG. 2*a*) shows a workpiece 10 in the form of a metal sheet 12 which has an edge 14 which is to be at least partly rolled. The shape of the workpiece 12 corresponds to the shape of the workpiece 102 in FIG. 1*a*) and accordingly this workpiece 12 has a portion 16 in which the workpiece 12, but in particular the edge 14, has a curvature.

In contrast to the metal sheet 102 in FIG. 1*a*), the metal sheet 12 is now provided in such a way that there is a material projection 17 in the portion 16 which has the curvature, this material projection 17 extending in the longitudinal direction of the edge 14 (x direction) over a part of the edge 14 to be rolled. In the region of the material projection 17, the edge 14*a* projects beyond the edge 14*b* or 14*c*, adjoining the material projection 17, transversely to the longitudinal direction of the edge 14, i.e. in the y direction. The material projection 17 extends over a location 19 having the smallest radius of the curvature of the section 16 on both sides of the location 19. In this case, the edge 14*a* of the material projection 17 merges smoothly into the edge 14*b* or 14*c* adjoining the material projection 17, to be precise with a respective sloping straight line 21 or 23, respectively, in the exemplary embodiment shown. However, instead of a straight transition between the edge 14*a* and the edge 14*c* or 14*b*, a curved, for example convexly curved or concavely curved, transition may also be selected.

The material projection 17 is in particular formed in one piece with the remaining material of the workpiece 10 or the metal sheet 12. The workpiece 10, preferably together with the material projection 17, is punched out of a flat product beforehand by a punching operation, the punching tool (not shown) accordingly being shaped in such a way that the material projection 17 is cut out of the flat product together with the remaining part of the metal sheet 12 during the punching operation.

FIG. 2*b*) shows in accordance with FIG. 1*b*) a rolling tool 18, having a tool top part 20 and a tool bottom part 22, the tool top part 20 being movable according to an arrow 24 towards the tool bottom part 22, or the tool bottom part 22 being movable against the arrow 24 towards the tool top part 20.

The metal sheet 12 is clamped in place in the tool bottom part 22.

Formed in the tool top part 20 is a hollow 26, which corresponds to the hollow 116 of the tool top part 110 in FIG. 1. It may also be noted at this point that both the hollow 116 and the hollow 26 correspond to the curve shape or line shape of the edge 104 or of the edge 14 in the longitudinal direction of the edge 104 or of the edge 14, respectively, perpendicularly to the drawing plane in FIG. 1*b*) and FIG. 2*b*).

If the metal sheet 12 is now pressed into the hollow 26 by the relative movement between the tool top part 20 and the tool bottom part 22, according to FIG. 2*d*), first of all only the material projection 17 or its edge 14*a* comes into engagement with the hollow 26 of the tool top part 20 and is rolled. On the other hand, the remaining edge 14 of the metal sheet 12 is first off still disengaged from the tool, top part 20. In FIG. 2*c*), the workpiece 10 is shown in the intermediate stage of the rolling operation, in which only the material projection 17 is partly rolled (according to FIG. 2*d*) over a rolling angle of about 90°, whereas the remaining edge 14 of the metal sheet 12 is not yet rolled.

During the further rolling according to FIG. 2*f*), the remaining edge 14 now also comes into engagement with the hollow 26 of the tool top part and is rolled, according to FIG. 2*f* over a rolling angle of about 180°. In the process, the material projection 17 has been further rolled according to FIG. 2*f*), to be precise by about 270°. As shown in FIG. 2*e*), no kink is now produced in the edge 14 of the metal sheet 12 during the rolling in the section 16, in contrast to the method according to FIG. 1. The material projection 17 has prevented a kink from being produced, or has at least reduced the risk of such a kink being produced.

It goes without saying that, within the scope of the invention, the curvature may be present not only in one plane but also in two or three planes.

Figure 2:
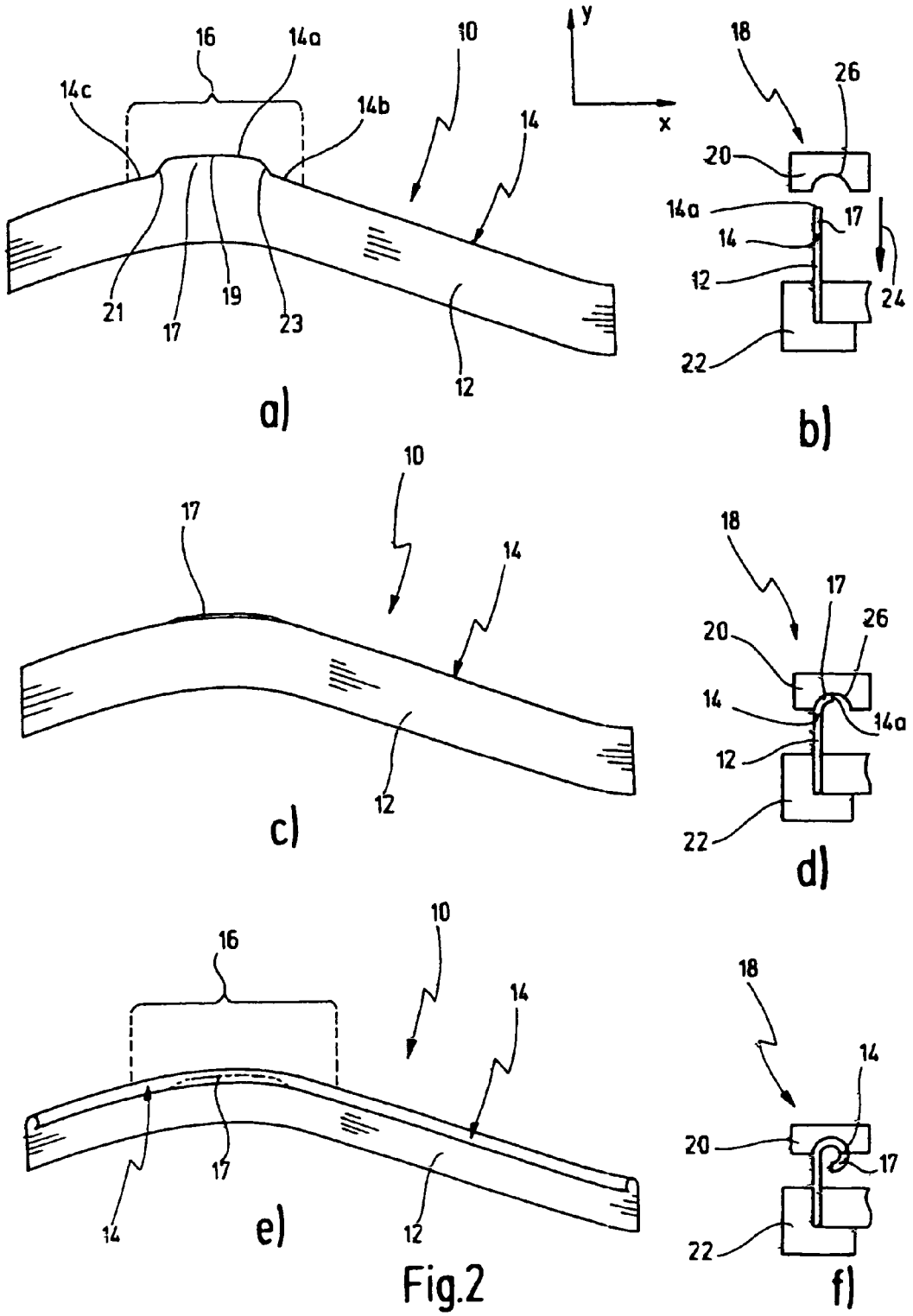
FIGS. 2*a*)-2*f* show illustrations of a method corresponding to FIGS. 1*a*) to 1*f*) for producing a workpiece in the form of a metal sheet having an at least partly rolled edge according to the present invention.

The workpiece 10, which in this way has been produced with a rolled edge, may in particular be a backrest part of a motor vehicle seat, this backrest part having a curvature as shown, for example, in FIG. 2. With the method according to the invention for producing the workpiece 10 with rolled edge 14, a workpiece 10, suitable for further use or processing, for such a backrest part is obtained, which cannot be produced with the conventional method or can only be produced with difficulty.

The invention claimed is:

1. A method for producing a workpiece in the form of a metal sheet with at least one at least partly rolled edge, said at least one edge to be rolled having a length in a longitudinal direction and a curvature in at least one portion along said longitudinal direction, comprising the steps of:

providing said workpiece, in said at least one portion which has said curvature, with at least one material projection extending in said longitudinal direction over a part of said length of said at least one edge to be rolled, so that said edge, along said material projection, projects transversely to said longitudinal direction beyond remaining portions of said edge adjoining said material projection before the edge is rolled, and subsequently rolling said edge including said material projection.

2. The method of claim 1, wherein said at least one material projection extends across a smallest radius of said curvature.

3. The method of claim 1, wherein said at least one material projection merges smoothly into said remaining portions of said edge adjoining said material projection.

4. The method of claim 3, wherein said at least one material projection merges in a sloping straight line into said remaining portions of said edge adjoining said material projection.

5. The method of claim 3, wherein said at least one material projection merges in at least one of a convex and concave line into said remaining portions of said edge adjoining said material projection.

6. The method of claim 1, wherein said workpiece is formed in one piece including said at least one material projection.

7. The method of claim 6, wherein said workpiece is provided together with said at least one material projection as a one-piece punched part.

8. A workpiece in the form of a metal sheet having a longitudinal dimension and at least one portion thereof having a curvature and at least one at least partly rolled edge extending over a length of the workpiece, and produced according to a method comprising the steps of:

providing in said at least one portion of said workpiece which has said curvature, with at least one material projection extending in said longitudinal direction over a part of the length of edge to be rolled, so that said edge, along said material projection, projects transversely to said longitudinal direction beyond remaining portions of said edge adjoining said material projection before the edge is rolled, and subsequently rolling said edge including said material projection.

9. The workpiece of claim 8, wherein said at least one material projection extends across a smallest radius of said curvature.

10. The workpiece of claim 8, wherein said at least one material projection merges smoothly into said remaining portions of said edge adjoining said material projection.

11. The workpiece of claim 10, wherein said at least one material projection merges in a sloping straight line into said remaining portions of said edge adjoining said material projection.

12. The workpiece of claim 10, wherein said at least one material projection merges in at least one of a convex and concave line into said remaining portions of said edge adjoining said material projection.

13. The workpiece of claim 8, wherein said workpiece is formed in one piece including said at least one material projection.

14. The workpiece of claim 8, wherein said workpiece is provided together with said at least one material projection as a one-piece punched part.

* * * * *